US005586707A

United States Patent [19]

Haskell

[11] Patent Number: 5,586,707

[45] Date of Patent: Dec. 24, 1996

[54] HOLDER FOR SCORECARDS

[76] Inventor: Christopher F. Haskell, 73 Kenneth Rd., Marblehead, Mass. 01945

[21] Appl. No.: 450,635

[22] Filed: May 25, 1995

[51] Int. Cl.[6] ..... A45F 5/00

[52] U.S. Cl. ..... 224/684; 224/675; 224/683; 224/242; 224/277; 224/660

[58] Field of Search ..... 224/224, 240, 224/226, 227, 228, 235, 236, 277, 901, 660, 663, 665, 671, 673, 674, 675, 676, 677, 680, 681, 682, 683, 684, 242, 246, 904, 312; D3/226, 227, 247, 249, 253; 150/130, 135; 206/315.1, 214, 371, 478, 479; 2/311, 321, 322, 312, 317, 321

[56] References Cited

U.S. PATENT DOCUMENTS

| | | | |
|---|---|---|---|
| 312,085 | 10/1885 | Claghorn | 224/904 |
| D. 348,776 | 7/1994 | Anderson | D3/226 |
| 367,996 | 8/1887 | Nathan | 224/226 |
| 1,648,565 | 11/1927 | Primley | 224/240 |
| 1,978,970 | 10/1934 | Thornhill et al. | 150/130 |
| 2,682,981 | 7/1954 | Previdi | 224/674 |
| 3,823,814 | 7/1974 | Lum | 206/478 |
| 4,641,751 | 2/1987 | Walker | 206/479 |
| 4,645,105 | 2/1987 | Plumbridge | 224/277 |
| 4,722,464 | 2/1988 | Wright | 224/235 |
| 4,726,077 | 2/1988 | Batiste | 2/321 |
| 4,736,853 | 4/1988 | O'Mara | 224/236 |
| 4,893,739 | 1/1990 | Conner | 224/240 |
| 4,932,576 | 6/1990 | Ashley | 224/904 |
| 5,226,195 | 7/1993 | Pappas, Jr. | 2/321 |

FOREIGN PATENT DOCUMENTS

| | | | |
|---|---|---|---|
| 803278 | 10/1958 | United Kingdom | 224/312 |
| 2104774 | 3/1983 | United Kingdom | 224/240 |

*Primary Examiner*—Henry J. Recla
*Assistant Examiner*—Gregory M. Vidovich
*Attorney, Agent, or Firm*—O'Connell Law Firm

[57] ABSTRACT

A holder for a scorecard includes a scorecard retaining unit which is secured to a wearer's waist in a freely slidable relationship. The retaining unit may be comprised of three generally planar sections joined together at their ends with one section having a scorecard retained on its inside face and one section having two loops attached to its outside face. The freely slidable association of the unit relative to the wearer's waist is accomplished by an outer elongated strip which surrounds a wearer's waist, passes through the two loops on the retaining unit and is attached at its ends to a belt which also surrounds the wearer's waist.

16 Claims, 4 Drawing Sheets

HOLDER FOR SCORECARDS

FIELD OF THE INVENTION

This invention relates to a holder for scorecards or the like.

BACKGROUND

Keeping score is an inherent part of many sports. Often, players keep score manually on scorecards. This is particularly true in amateur athletics, and it is especially the case in amateur golf outings. Consequently, at least one of the participants must carry the card and update it periodically to reflect changes in score. For example, the scorekeeper in a game of golf normally will update the player's scores after each hole. For four players playing eighteen holes, the scorecard must be marked no less than seventy-six times (including totaling.)

When golfers use a motorized cart, such continual scoring is made relatively convenient by the inclusion of a permanent card holder mounted on the cart. However, this method necessarily leaves the players without the card whenever they are away from the cart. Also, the card is exposed to the elements, and a paper scorecard pelted by rain quickly becomes unusable.

When golfers opt for a manual pull cart, they again may employ some type of card holder mounted on the cart. This practice also makes the card somewhat accessible. However, it is not available on many carts; it leaves the card exposed to the elements; it may interfere with access to golf clubs; and it leaves the player without the card whenever he or she is away from the cart.

Golfers also have the option of walking the course carrying their golf bags. A different and arguably more inconvenient set of problems with respect to scoring affects these golfers. While the card is always with the golfer, it often must be stuffed in the golfer's pocket and retrieved each time a score is to be entered. With this, the paper card can suffer damage such as tearing or crumpling. Also, rain and other dampness can easily seep through a golfer's clothing to add to the damage the card suffers. Furthermore, it is cumbersome to fish through one's pockets to find the card and the accompanying pencil. This problem is aggravated by the ease of tactile confusion of objects in the golfer's pocket. For example, the scorecard can be confused with money and other paper goods, and the pencil can be confused with golf tees and other like objects. Furthermore, when withdrawing a scorecard from his or her pocket, a golfer may mistakenly pull out and drop other objects, such as money.

In light of the above, there is a need for a holder for scorecards and the like which allows easy access to the scorecard, protects it from the multitude of damaging forces which might otherwise affect it, and allows it to remain with the user at all times.

SUMMARY

With the foregoing in mind, the present invention is principally directed to providing a holder for scorecards and the like which is easily accessible to its user.

A further object is to provide a holder which is of little interference with the user's mobility or downward vision.

Another object is to provide a holder which shields the scorecard or the like from the elements and other damaging forces.

Still another object is to provide a holder which is durable.

A further object of the present invention is to provide a device for holding scorecards and the like which provides a rigid backing surface to increase the ease and legibility with which scores may be added to the card.

A related object is to provide a holder which provides a rigid backing surface to prevent damage to the scorecard or the like when in use.

Yet another object of the invention is to provide a holder which includes a pocket and is capable of holding a writing utensil.

From this specification, these and other objects and advantages of the present invention will become obvious to those skilled in the art. To attain these, the present invention essentially comprises a scorecard retaining unit and a means for slidably attaching that retaining unit to the user's waist. A single means could accomplish the dual purposes of securing the invention about the user's waist and slidably attaching the retaining unit. In accomplishing those purposes, that means may employ two subsidiary means as parts thereof. For example, there may be a slidably attaching means and a holding means such as a belt. The slidably attaching means would slidably attach the retaining unit to the belt, and the belt would hold the retaining unit and the slidably attaching means about the user's waist. In such an embodiment of the invention, the belt has a first end and a second end. The first end has a first fastening means, and the second end has a second fastening means. The fastening means can be of any suitable type such as male and female plastic dip fasteners, a hook and loop device, a traditional belt-style means, or any other suitable fastening means.

The slidable attachment of the scorecard retaining unit gives the user convenient access to the scorecard or the like while allowing for unhindered mobility and vision. For example, a user can slide the retaining unit to his or her front side to enter a score or other mark most conveniently, and a user can slide the retaining unit to his or her back side when mobility and downward vision are required (i.e. when a golf shot is to be made.)

The scorecard retaining unit may take many forms such as a flat board or a wallet. However it is formed, the retaining unit should be constructed to retain a scorecard. The embodiment of the invention described more particularly below contemplates a retaining unit in the form of a three-sectioned wallet which retains the scorecard or the like within it. To ensure a firm writing surface under the scorecard or the like, there may be included a substantially rigid, generally planar board within the section which retains the scorecard. The board may be of approximately the same size as the scorecard or the like. The unit may be further adapted to retain a writing utensil with an elastic loop, a clip, or some other suitable writing utensil retaining means. The retaining unit may include further a pocket in one of the three sections.

The slidably attaching means may be comprised of, in combination, an outer elongated strip and two loops. In the preferred embodiment, the elongated strip, with first and second ends, is generally equal in length and width to the belt. The first end of the elongated strip is attached to the first end of the belt, and the second end of the elongated strip is attached to the second end of the belt. The two loops can be of many shapes, in this embodiment they are generally rectangular, each having first and second sides. They are secured at their first sides to the outside of the retaining unit. The elongated strip passes through the loops. By this arrangement, the belt goes about the user's waist, and the elongated strip generally tracks the path of the belt. The retaining unit, held onto the elongated strip by the loops, can slide along the elongated strip with relatively low friction.

The scorecard retaining unit also can be separable from the belt and the elongated strip, and it may further be provided with two small bands on its outside. The bands have first ends which are permanently connected to the retaining unit. They have second ends which may be detachably connected to the retaining unit by, for example, hook and loop devices. With these bands, the retaining unit may be attached directly to one's traditional belt without need for the elongated strip or the bands. To do so, the user may detach the second end of each band, pass the traditional belt under the bands, and reattach the second ends of the bands thereby effectively attaching the retaining unit to the traditional belt. By doing this, one could enjoy many of the advantages of the invention without the belt or the sliding means. However, one probably would be unable to slide the retaining unit about his or her waist.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details of construction, descriptions of geometry, and illustrations of inventive concepts is a mere example of a possible manifestation of the invention.

DETAILED DESCRIPTION OF THE PREFERRED EMBODIMENT

Figure 1:
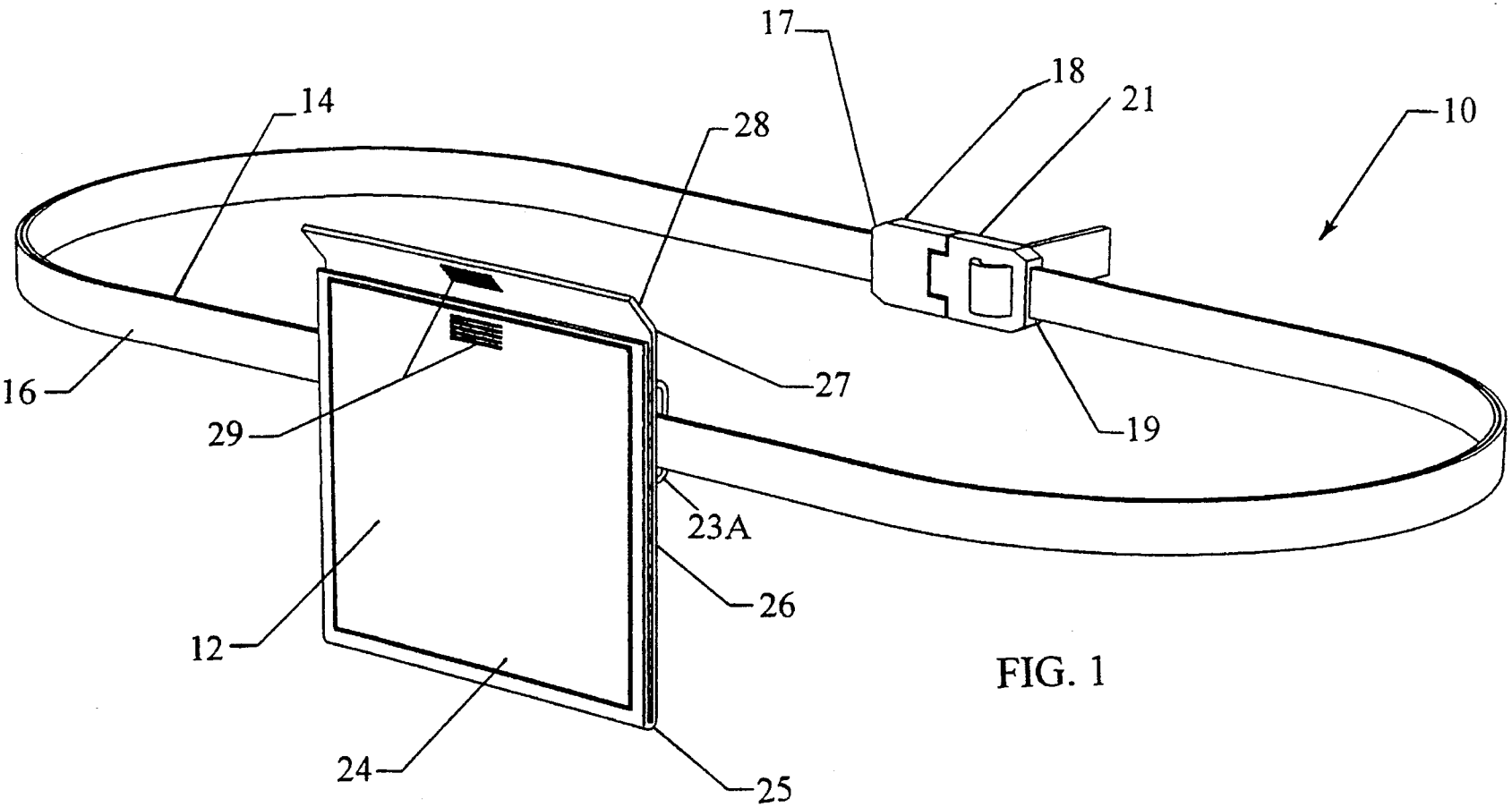
FIG. 1 is a three-dimensional perspective representation of the scorecard holder as it might appear in use.

The invention may be adapted to retain many types of objects to be marked. For example, it may be adapted to retain a scorecard or any other object which is subject to repetitious marking. The embodiment of the invention shown in the drawings and described below is adapted to retain a scorecard. FIG. 1 shows the scorecard holder 10. It comprises a scorecard retaining unit 12 which is slidably engaged to a belt 14 by a slidably attaching means 15. The scorecard holder 10 is secured about the waist of its user by passing the belt 14 around the user's waist and then fastening a first fastening means 18 to a second fastening means 21.

Figure 2:
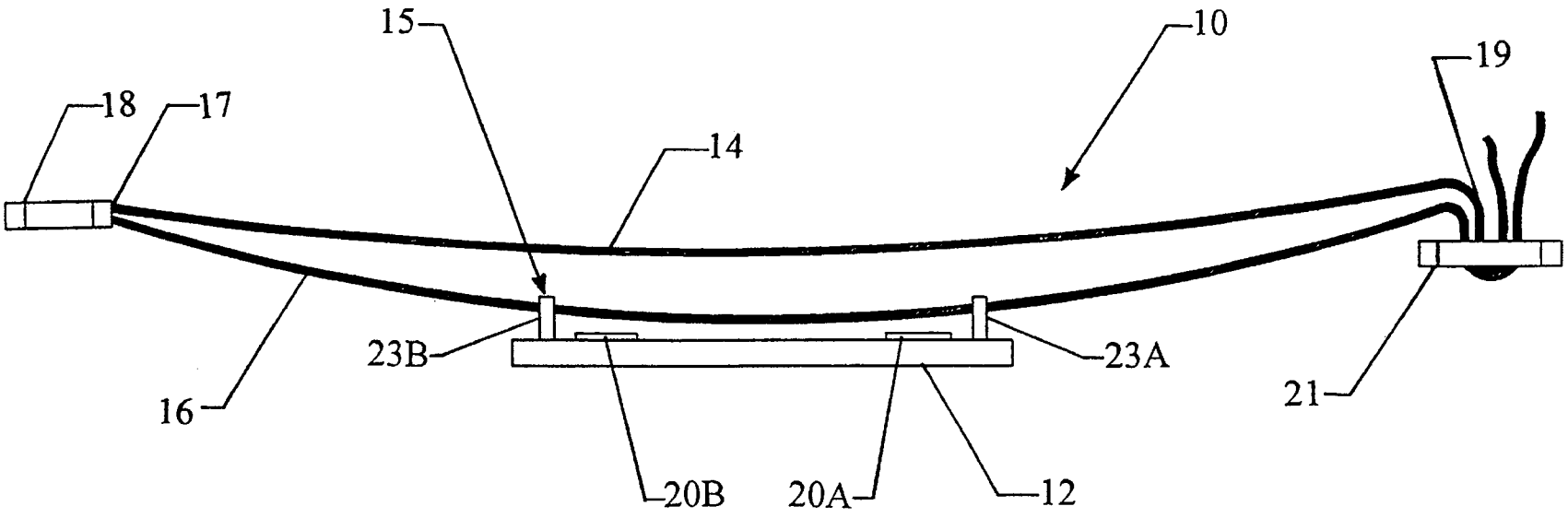
FIG. 2 is a top plan view of the holder.
Figure 3:
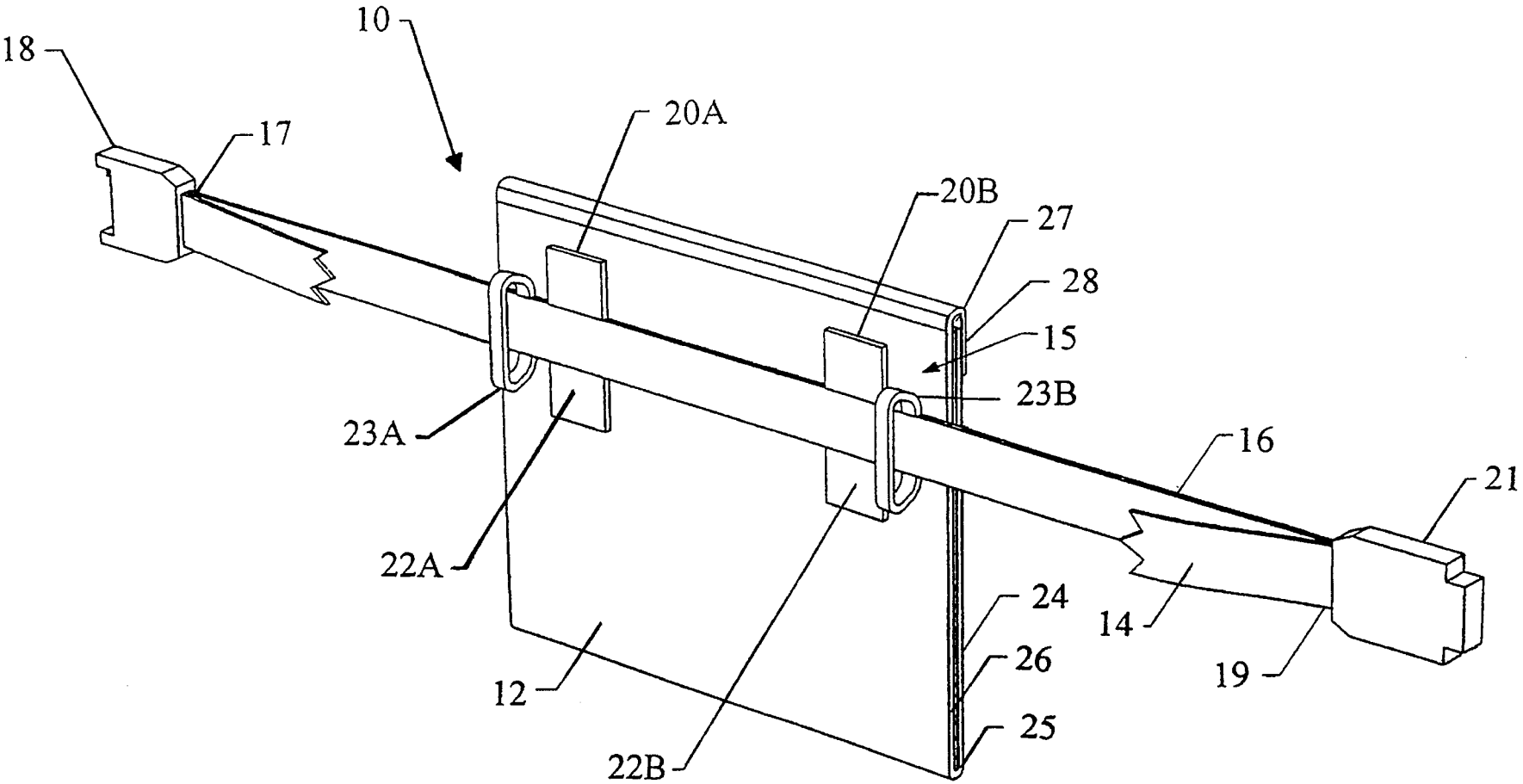
FIG. 3 is a rear elevational view of the holder partially opened.

The slidably attaching means 15 included in the preferred embodiment can be understood by reference to FIGS. 2 and 3. It is comprised essentially of an outer elongated strip 16 and two plastic, generally rectangular loops 23A and 23B. Each loop has an opening therein defined by a first side, a second side opposite the first side, a top, and a bottom opposite the top. The first side of each of the loops 23A and 23B is secured to the outside face of a second section 26 of the retaining unit 12. The second side of each loop is free. The elongated strip 16 passes through each of loops 23A and 23B causing the second side of each of loops 23A and 23B to slide in between the elongated strip 16 and the belt 14. By this arrangement, the retaining unit 12 may be slid along substantially the entire length of the belt 14 with minimal frictional interference.

Consequently, the user can slide the retaining unit 12 to his or her front side to enter a score. When added mobility and downward vision are needed, the user can slide the retaining unit 12 to his or her back side. For example, one might wish to slide the retaining unit 12 to his or her back side when seeking to make a golf shot or the like, but one probably would need to slide it to his or her front side to record the resulting score.

The outer elongated strip 16 is of substantially the same length as the belt 14. It is permanently connected to the belt at a first end 17 by a first fastening clip 18. At a second end 19 of the outer elongated strip 16, the elongated strip 16 and the belt 14 are separably connected by a second fastening clip 21. The first fastening clip 18 and the second fastening clip 21 can be connected together to fasten the belt about the user's waist. The second fastening clip 21 may be detached from the belt 14 and the elongated strip 16 such that the belt 14 and the elongated strip 16 are separate at the second end 19. With the second fastening clip 21 removed, a user can slide the retaining unit 12 off of the end of the elongated strip 16.

Once separated from the belt 14 and the elongated strip 16, the retaining unit 12 may be connected to the user's traditional belt by means of two rectangular bands 20A and 20B which are attached to the outside face of the second section 26 of the retaining unit 12. The bands 20A and 20B each have a first end and a second end. The first ends are permanently connected to the outside face of the second section 26, while the second ends are detachably connected thereto by means of hook and loop devices 22A and 22B. The bands 20A and 20B are arranged with their lengths generally parallel to each other with both lengths being generally perpendicular to first and second hinge means 25 and 27. With these bands 20A and 20B, the retaining unit 12 may be attached to one's traditional belt by detaching the second ends of the bands 20A and 20B, sliding the belt under the bands 20A and 20B, and then reattaching the second ends of the bands 20A and 20B. By doing this, the retaining unit 12 is conveniently accessible to the user without the need for the belt 14 and the outer elongated strip 16. However, in this arrangement, the retaining unit 12 probably could not be slid about the user's waist.

Figure 4:
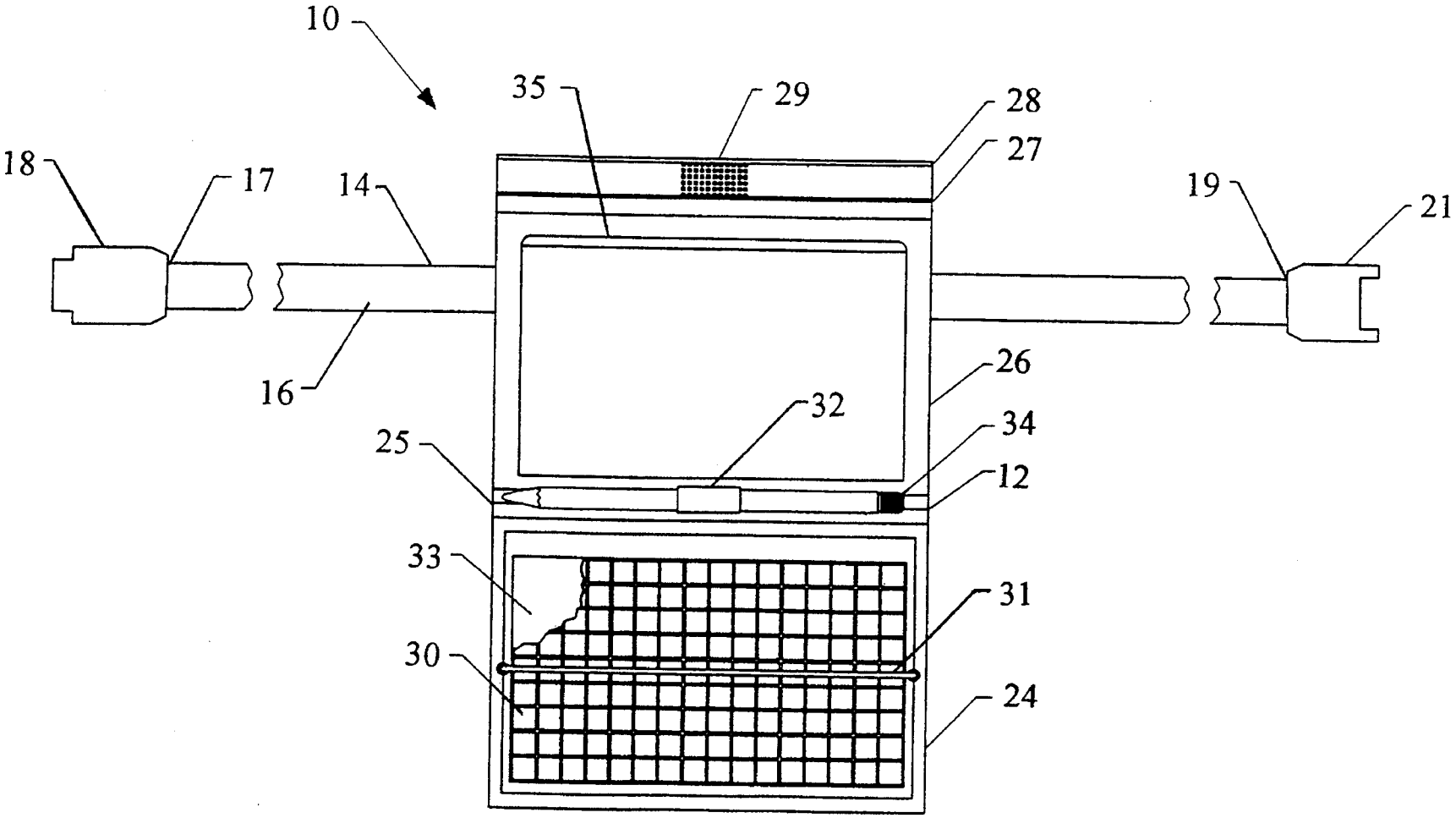
FIG. 4 is a front elevational view of the holder fully opened with a partial section therein for showing the board contained within the retaining unit.

FIG. 4 shows the scorecard holder 10 with its scorecard retaining unit 12 fully opened. The retaining unit 12 is comprised of first, second, and third sections, 24, 26, and 28 respectively. Each section has a first end and a second end and an inside face and an outside face. The sections are generally flat and generally rectangular and are generally equal in width. The first section 24 and the second section 26 are of approximately equal length, but the third section 28 is of lesser length than the first and second sections 24 and 26 such that it acts as a mere flap for holding the retaining unit shut.

The sections are connected with the first end of the first section 24 being free; the second end of the first section 24 connected by a first hinge means 25 to the first end of the second section 26; the second end of the second section 26 connected by a second hinge means 27 to the first end of the third section 28; and the second end of the third section 28 is free. The body of the retaining unit 12 may be formed by two layers of any sufficiently flexible material. For example, nylon, canvas, leather, vinyl, cotton fabric, or any other suitable material may be used. Joined together to form a double thickness, the two layers each span the length of the retaining unit 12 thereby forming the first, second, and third sections 24, 26, and 28 and the first and second hinge means 25 and 27.

In use, the sections 24, 26, and 28 are folded along the first hinge means 25 and the second hinge means 27 such that the inside faces of the first section 24 and the second section 26 are in a contacting, facing relationship and the third section 28 folds over the first end of the first section 24 such that its inside face is in a contacting, facing relationship with the outside face of the first section 24. In the preferred embodiment, the inside face of the third section 28 and the outside face of the first section 24 are detachably connected by a connecting means such as a button, a clip or the hook and loop device 29.

On the inside face of the first section 24, a scorecard 30 is held in place by a scorecard retaining means such as the elasticized band 31 which travels across substantially the entire width of the inside face of the first section 24. Advantageously, the relatively narrow and flexible band 31 adequately retains the scorecard 30 while permitting substantially unobstructed and ready access thereto for marking. To provide a firm writing surface for the scorecard 30, the first section 24 further includes a substantially rigid, generally planar board 33 of approximately the same size as the scorecard 30 to be held. The board 33 is sewn in place in between the two layers of the flexible material which forms the body of the retaining unit 12. In the location of the first hinge means 25, there is an elastic writing utensil retaining loop 32 which can be used to retain a writing utensil 34. The loop 32 has an opening sufficiently smaller than the size of the writing utensil that the writing utensil will be retained thereby. The retaining unit 12 includes a pocket 35 in its second section 24. The pocket 35 is formed by sewing the two layers of flexible material together at both sides of the second section 26 and at the first end of the second section 26 and by cutting a slit into the inside layer of the second end of the second section 24. The slit travels substantially the entire width of the second section 24.

Using the present form of the invention, a score keeping competitor can enter a score by sliding the scorecard retaining unit 12 to his or her front side, disconnecting the third section 28 from the first section 24, opening the retaining unit 12, sliding the writing utensil 34 out of the writing utensil retaining loop 32, recording the appropriate score(s) on the scorecard 30, reinserting the writing utensil 34 in the writing utensil retaining loop 32, closing the retaining unit 12, and reattaching the third section 28 to the first section 24. With the score entered, the score keeper may slide the retaining unit 12 about his or her waist to his or her back side so that the retaining unit 12 provides little or no interference with the user's mobility or downward vision.

From the foregoing, it is apparent that the present invention has many advantages. These include the ability to provide a durable device for holding scorecards or the like which, due to its ability to slide about the user's waist with little friction, is easily accessible to its user while providing minimal interference with the user's mobility or downward vision. Furthermore, the invention protects the scorecard or the like from the elements and avoids the wear and tear of multiple retrievals from a user's pocket. The device also adds to the legibility with which scores and other marks may be entered by providing a firm writing surface.

The foregoing discussion is set forth merely as an example of a given manifestation of the inventive concept, and those skilled in the art will appreciate that concept may give rise to other forms. Therefore, the claims which follow shall be deemed to include such equivalent constructions insofar as they do not depart from the spirit and scope of the present invention.

I claim:

1. A holder for a scorecard, the holder comprising:

a) a scorecard retaining unit comprised of a first section, a second section, and a third section; each section being generally flat and generally rectangular and having an inside face, an outside face, a first end, and a second end; the first section having its firm end free and its second end connected by a first hinge means to a first end of the second section; the second end of the second section connected by a second hinge means to a first end of the third section; and the second end of the third section being free; such that the retaining unit may be folded along the first and second hinge means so that the inside faces of the first and second sections are in a contacting relationship and the third section folds over the first end of the first section such that its inside face is in a contacting relationship with the outside face of the first section;

b) a means for slidably securing the scorecard retaining unit to the user's waist so that the user may slide the scorecard retaining unit about substantially the entire waist of the user;

c) a means for retaining a scorecard secured to the inside face of one of the sections, the scorecard retaining means is comprised of a narrow elasticized band having a first end and a second end and travelling freely across substantially the entire inside face of the section upon which a scorecard is to be retained; the elasticized band being secured at each of its ends to the section whereby the wearer's access to the scorecard is not materially interfered with and substantially the entire scorecard may be marked without being removed from the scorecard retaining unit; and d) the sections of the retaining unit being formed of a flexible material with that material connecting the sections and thereby acting as the first and second hinge means.

2. The holder of claim 1 wherein the slidably securing means is comprised of a means for holding the holder about the user's waist and a means for slidably attaching the scorecard retaining unit to the holding means.

3. The holder of claim 1 wherein the scorecard retaining means is secured to inside face of the first section.

4. The holder of claim 1 wherein the flexible material is selected from the group consisting of canvas, nylon, leather, vinyl, and cotton fabric.

5. The holder of claim 1 further comprising an elastic loop secured to the retaining unit for retaining a writing utensil; the elastic loop having an open are sufficiently smaller than the cross section of the writing utensil such that the writing utensil can be retained thereby.

6. The holder of claim 1 further comprising a means for detachably connecting the inside face of the third section to the outside face of the first section and a substantially rigid, generally planar board of approximately the size of the scorecard to be retained; the board being held between the two layers of the section upon which the scorecard is to be retained whereby protection and a firm writing surface are provided for the scorecard.

7. The holder of claim 6 wherein the detachably connecting means is comprised of a hook and loop device.

8. A holder for a scorecard, the holder comprising:

a) a belt for holding the holder about the user's waist having a first end and a second end, the belt capable of encircling the user's waist;

b) a fastening means for connecting the first end of the belt to the second end of the belt;

c) a scorecard retaining unit having a first section, a second section, and a third section; each section being generally flat and rectangular; and each section having a first end and a second end and an inside face and an outside face; all three sections of approximately equal width; the first and second sections being substantially the same length from first end to second end; the sections being joined with the first end of the first section being free, the second end of the first section being connected by a first hinge means to the first end of the second section, the second end of the second section being connected by a hinge means to the first end of the third section, and the second end of the third section being free; such that the retaining unit may be folded along the first and second hinge means so that the inside faces of the first and second sections are in a contacting relationship and the third section folds over the first end of the first section with its inside face in a contacting relationship with the outside face of the first section;

d) a means for slidably attaching the scorecard retaining unit to the belt comprised of at least one loop affixed to the outside of the retaining unit and an outer elongated strip; the outer elongated strip traveling substantially the entire length of the belt and having the first end connected to the first end of the belt and a second end connected to the second end of the belt; the at least one loop having an open area therein defined by a first side, a second side across from the first side, a top, and a bottom across from the top; the outer elongated strip being threaded through the at least one loop whereby the retaining means can slide along the elongated strip for substantially the entire length of the belt; and (e) a means for retaining a scorecard secured to the inside face of one of the sections.

9. The holder of claim 8 wherein the slidably attaching means includes two loops, the loops being generally rectangular in shape.

10. The holder of claim 8 wherein the means for retaining a scorecard is secured to the inside face of the first section and is comprised of a narrow elasticized band having a first end and second end and traveling freely across substantially the entire inside face of the first section; the elasticized band being secured at each of its ends to the first section whereby the wearer's access to a scorecard is not materially interfered with and a scorecard may be marked without being removed from the scorecard retaining unit.

11. The holder of claim 8 wherein the outer elongated strip is permanently connected at its first end to the first end of the belt, and the second end of the elongated strip is detachably connected to the second end of the belt such that the user may separate the second ends of the belt and the elongated strip to slide the retaining unit off of the elongated strip.

12. The holder of claim 8 further comprising at least one band of generally rectangular shape having a first end and a second end; the first end of the at least one band being permanently attached to the outside face of the second, and the second end being detachably attached to the outside face of the second section; the at least one band being oriented such that a line running through the middles of the first and second ends would be generally perpendicular to a line following the path of the first hinge means.

13. The holder of claim 12 wherein there are two bands.

14. The holder of claim 8 wherein the retaining unit is constructed to retain a golf scorecard.

15. A holder for a scorecard, the holder comprising:

(a) a scorecard retaining unit formed by joining a multiplicity of generally flat, generally rigid, generally rectangular panels, each said panel having a first end and a second end; each said panel being joined in succession at one of the respective ends with hinge means; each said panel having an inside face and an outside face; one of said panels having attached to its inside face a means for retaining a scorecard; whereby the panels may be folded along the hinge means, and the scorecard may be held by the retaining means in between the folded panels;

(b) said mean for retaining a scorecard being adapted to retain a scorecard without materially interfering with a wearer's access to the scorecard for making whereby substantially the entire scorecard may be marked without being removed from the scorecard retaining unit;

(c) an elongated strip for surrounding the wearer's waist without being threadably associated with the wearer's clothing; and (d) a means for slidably connecting the retaining unit to the elongated strip whereby the wearer may slide the scorecard retaining unit about substantially the entire waist of the wearer in a substantially unobstructed manner.

16. The holder of claim 15 wherein the scorecard retaining means is comprised of a narrow elasticized band having a first end and a second end, traveling freely across substantially the entire at least one panel, and being secured at its first and second ends to the at least one panel.

* * * * *